US006575590B1

(12) United States Patent
Wadsworth

(10) Patent No.: US 6,575,590 B1
(45) Date of Patent: Jun. 10, 2003

(54) LIGHT SYSTEM FOR BATTERY POWERED DRILL

(76) Inventor: Jake Wadsworth, 20 Dublin Gulch Rd., St. Ignatius, MT (US) 59865

( * ) Notice: Subject to any disclaimer, the term of this patent is extended or adjusted under 35 U.S.C. 154(b) by 0 days.

(21) Appl. No.: 10/086,934

(22) Filed: Mar. 1, 2002

(51) Int. Cl.[7] ..... B25K 23/18
(52) U.S. Cl. ..... 362/119; 362/120; 362/194
(58) Field of Search ..... 362/119, 120, 362/194, 208, 372; D8/61, 26

(56) References Cited

U.S. PATENT DOCUMENTS 5,169,225 A * 12/1992 Palm ..... 362/118
D402,872 S * 12/1998 Clowers ..... D8/68
D444,363 S * 7/2001 Hayakawa et al. ..... D8/61
6,318,874 B1 * 11/2001 Matsunaga ..... 362/119
2002/0054494 A1 * 5/2002 Casas ..... 362/119

* cited by examiner

*Primary Examiner*—Sandra O'Shea
*Assistant Examiner*—Hargobind S. Sawhney
(74) *Attorney, Agent, or Firm*—Keith S. Bergman

(57) ABSTRACT

A light structure releasably interconnects between a battery powered drill and the powering battery to provide a drill light in a first mode and in a second mode releasably interconnects the powering battery therebelow and a handle structure thereabove to serve to as a stand alone light independent of the drill. The light structure pivotally carries a light source for vertically angulated positioning. The handle structure provides a pivotally interconnected L-shaped handle formed by two adjustably pivotally interconnected elongate elements to allow adjustable positioning of the light structure relative to an underlying supporting surface.

6 Claims, 4 Drawing Sheets

LIGHT SYSTEM FOR BATTERY POWERED DRILL

II. BACKGROUND OF INVENTION

IIA. Related Applications

There are no applications related hereto heretofore filed in this or in any foreign country.

IIB. Field of Invention

This invention relates generally to battery powered drills and more particularly to a light structure releasably attachable between the drill as its powering battery that has a releasably attachable handle to allow use as a stand alone light independent of the drill when powered by the drill battery.

IIC. Background and Description of Prior Art

With the advent of present day rechargeable batteries of relatively small size and long life that provide substantial power for longer periods between chargings, cordless battery powering has become popular for the operation of smaller hand tools. This has been especially true in the case of drills, which by their nature and use are well suited for powering by battery means. Often battery powered tools such as drills are used in poorly lighted areas, commonly more often than their corded relatives, because of the opportunities battery operated tools present for use in areas where wire transmitted power sources are not available. The instant invention provides a light structure for use with battery powered drills to illuminate the area in which the tool operates to facilitate tool use and also provides such a light structure that may be used independently as a stand alone light source having no attachment to the battery powered drill.

Most battery powered drills of the present day market place provide an elongate drill body with a medial depending handle releasably interconnecting, both structurally and electrically, a battery pack depending therebeneath. My light structure is particularly adapted for use with such drills in providing a structure that is releasably positionable between a powering battery and the powered drill. If the drill is removed from the light structure, an associated handle may be interconnected with the light structure to provide a battery powered light that is separate and independent from the drill.

Various light structures have heretofore become known for use with electrically powered drills, but in general those light structures have been particularly adapted for use only with the drill to light only the area at and about an area on a work piece where a drilling operation is carried out. The instant light structure is distinguishable from such prior light structures in that it is releasably positionable between the powering battery and the powered drill to allow selective use of the drill with or without the light structure and in providing an associated handle for use with the light structure to allow that structure and the releasably interconnected powering battery to serve as a stand alone light, completely separated from and independent of the drill, to light any desired area.

To provide maximum utility a drill light generally must provide illumination in the area where the drill bit is to operate. Since the general configuration of battery powered drills varies with individual manufactures and the lengths of various bits used in such tools vary, the instant light structure provides a movably mounted light source so that the generated light bean can be easily and conveniently manually positioned by the user to accommodate particular existent conditions and light particularly desired areas. This is accomplished by providing a light source, with a wide angle beam, that is pivotally mounted relative to the light structure to allow adjustable positioning through a substantial angular range in a vertical plane through the drill bit axis.

For the stand alone light formed by the releasably interconnected drill battery, light structure and handle structure to provide maximum utility, the light source must be positionable for a wide range of angulation and orientation relative to a surface supporting the light structure. The pivotal mounting of the light source on the light structure aids this function, but the pivotal mounting is substantially enhanced by the particular handle structure that provides an L-shaped handle pivotally mounted on the light structure and having two elongate elements pivotally interconnected with each other to form a handle that allows substantial variance in the positioning of the light beam generated by the light source when the light structure is supported on an underlying surface partially by the handle. The stand alone light's positioning is generally limited only by an operator's ingenuity in relatively positioning the elements of the light structure for support. This feature is particularly adapted to allowing the light beam to be angulated upwardly relative to the light structure to illuminate a work area such as the under surface of a vehicle or other structure spacedly above the light.

My invention does not reside in any one of these features individually, but rather in the synergistic combination of all of its structures which necessarily give rise to the functions flowing therefrom as herein specified, illustrated and claimed.

III. SUMMARY OF INVENTION

My invention generally provides a light structure for use with battery powered electric drills having a depending handle releasably carrying a removable battery therebeneath. The light structure has a lower connecting portion configured to releasably interconnect with the existing connecting structure of the battery and an upper connecting structure configuration to releasably interconnect with the existing connecting structure of the powered drill. The light structure provides a pivotally interconnected light source at the forward end to pivot in a vertical plane relatively to the vertically positioned drill to adjustably illuminate an area about that whereat a drill bit operates. An interconnectable handle structure provides a base having lower connecting structure configured to releasably interconnect the connecting structure defined by the upper portion of the light structure to aid manual manipulation and support of the light structure and an interconnected drill battery to serve as a stand alone light. The handle body pivotally carries an L-shape handle formed by two pivotally interconnected elongate elements to provide a wide range of support positions for the stand-alone light mode of the light structure on an underlying supporting surface.

In providing such a device, it is:

A principal object to provide a particular light structure for a battery powered drill that is releasably interconnectable, both structurally and electrically, between the drill and a powering battery.

A further object is to provide such a light structure that has a pivotally mounted light source in its forward portion to allow angularly adjustable positioning of the light source in a vertical plane.

A further object is to provide such a light structure that has an articulatible handle structure releasably interconnectable in the drill connecting structure to provide a stand alone light separate and disconnected from the drill when interconnected with the drill battery.

A further object is to provide such a handle structure that is pivotally connected with a handle for angular motion in a vertical plane.

A still further object is to provide such a handle that is formed by two pivotally interconnected elongate elements for pivotal motion in the same vertical plane as the pivotal motion of the handle to aid adjustable positioning of the light structure on an underlying supporting surface.

A still further object is to provide such a light structure that is of new and novel design, of a rugged and durable nature, of simple and economic manufacture and one that is otherwise well-suited to the uses and purposes for which it is intended.

Other and further objects of my invention will appear from the following specification and accompanying drawings which form a part hereof. In carrying out the objects of the invention however, it is to be understood that its features are susceptible of change in design and structural arrangement with only one preferred and practical embodiment of the best known mode being specified and illustrated in the accompanying drawings as is required.

V. BRIEF DESCRIPTIONS OF DRAWINGS

In the accompanying drawings which form a part hereof and wherein like numbers of reference refer to similar parts throughout:

VI. DESCRIPTION OF PREFERRED EMBODIMENT

Figure 2:
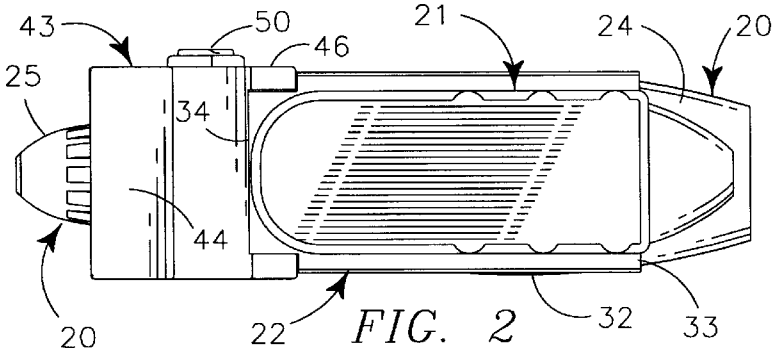
FIG. 2 is an orthographic bottom view of the drill of FIG. 1.
Figure 3:
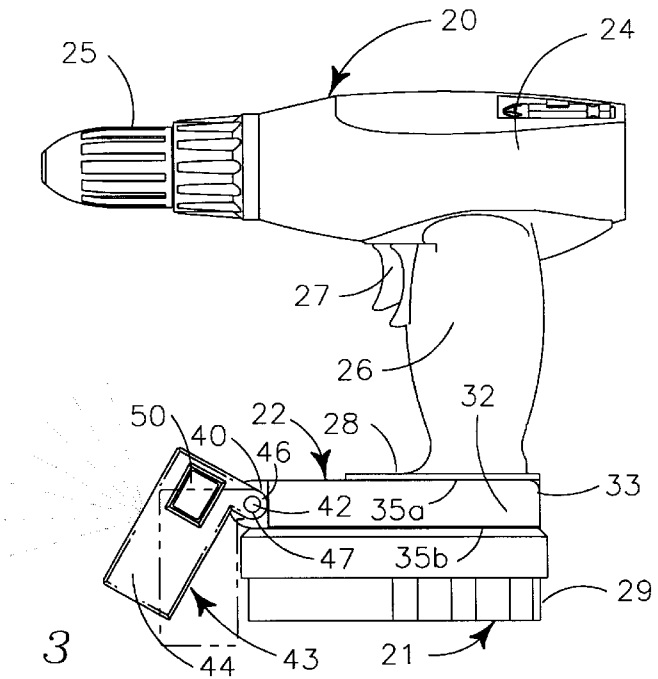
FIG. 3 is an orthographic left side view of the drill of FIG. 1.
Figure 1:
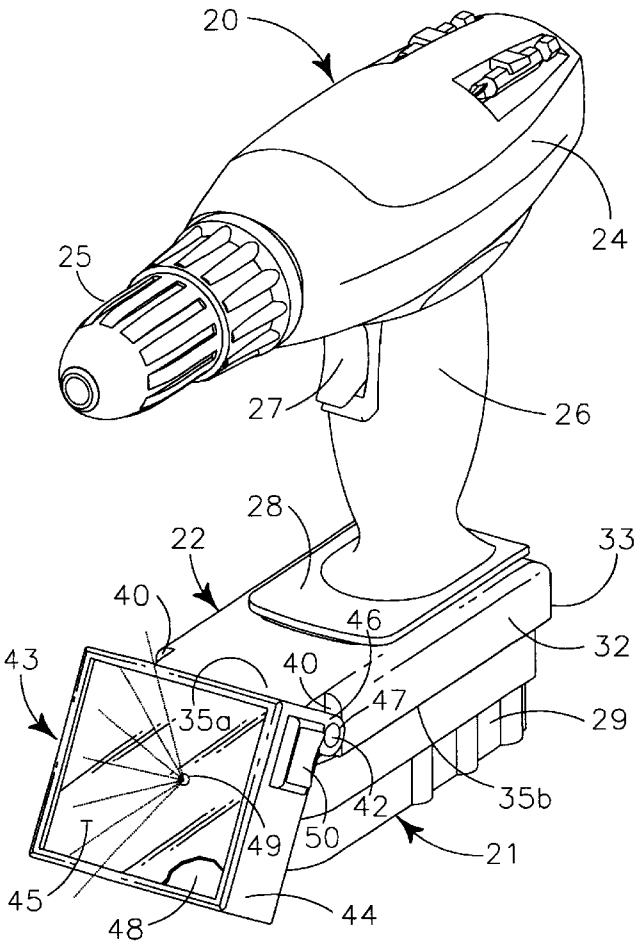
FIG. 1 is an isometric elevational view of a drill interconnecting my depending light structure and a powering battery.
Figure 5:
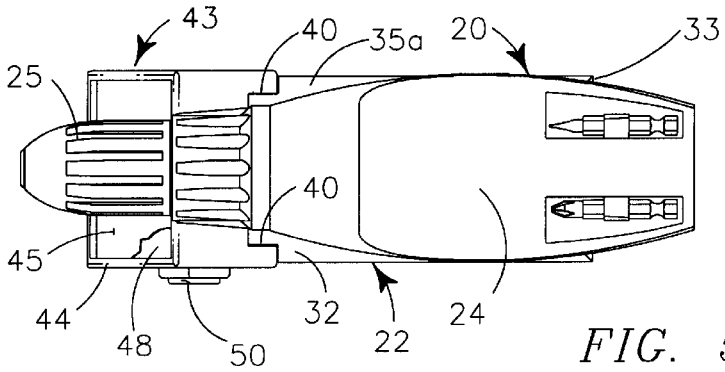
FIG. 5 is a top orthographic view of the drill of FIG. 1.
Figure 6:
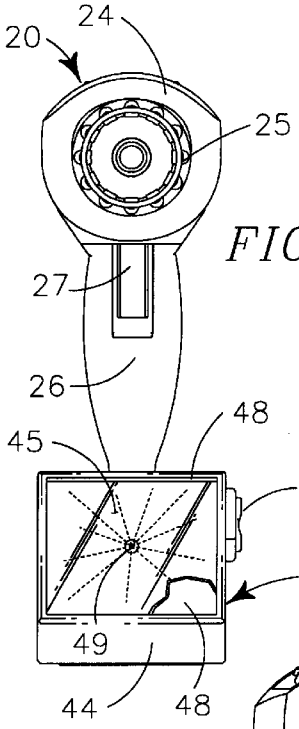
FIG. 6 is an orthographic front view of the drill of FIG. 1.
Figure 4:
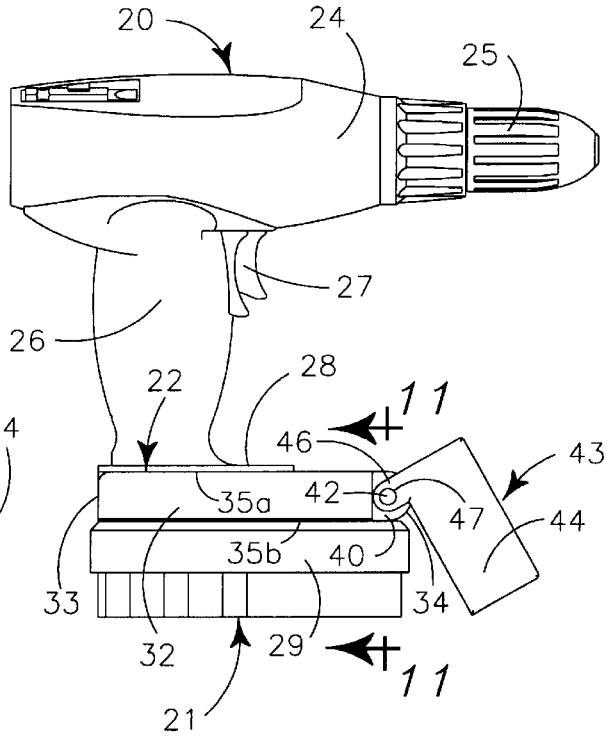
FIG. 4 is an orthographic right side view of the drill of FIG. 1.
Figure 7:
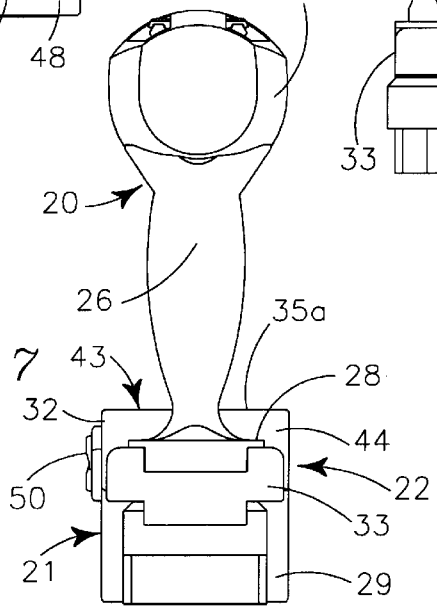
FIG. 7 is an orthographic back view of the drill of FIG. 1.
Figure 11:
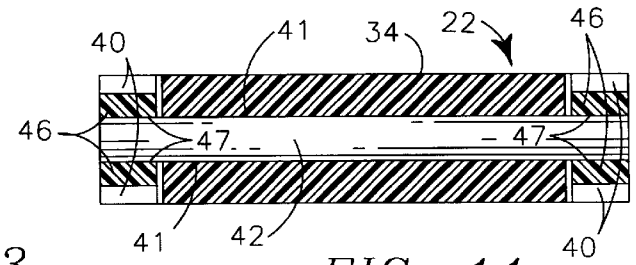
FIG. 11 is an enlarged laterally extending, vertical cross-sectional view through the pivotal joint connecting the light source and light structure, taken on line 11—11 on FIG. 4 in the direction indicated by the arrows thereon.

The instant light system is created for use with a cordless battery powered electric drill 20. A representative generic form of such a drill with which the light system is operative is illustrated particularly in FIGS. 1–7, where it is seen to provide elongate drill body 24 carrying a drill motor (not illustrated) powering rotatable chuck 25 in its forward end portion to releasably carry and positionally maintain tool bits. Elongate handle 26 depends from the medial portion of body 24 and carries finger switch 27 in the forward portion of the handle 26 immediately beneath the junction of the handle with body 24. The lowermost portion of handle 26 supports battery connecting structure 28, which without use of my light system, normally releasably interconnects, both structurally and electrically, battery casement, 29 carrying a powering battery (not illustrated).

Figure 9:
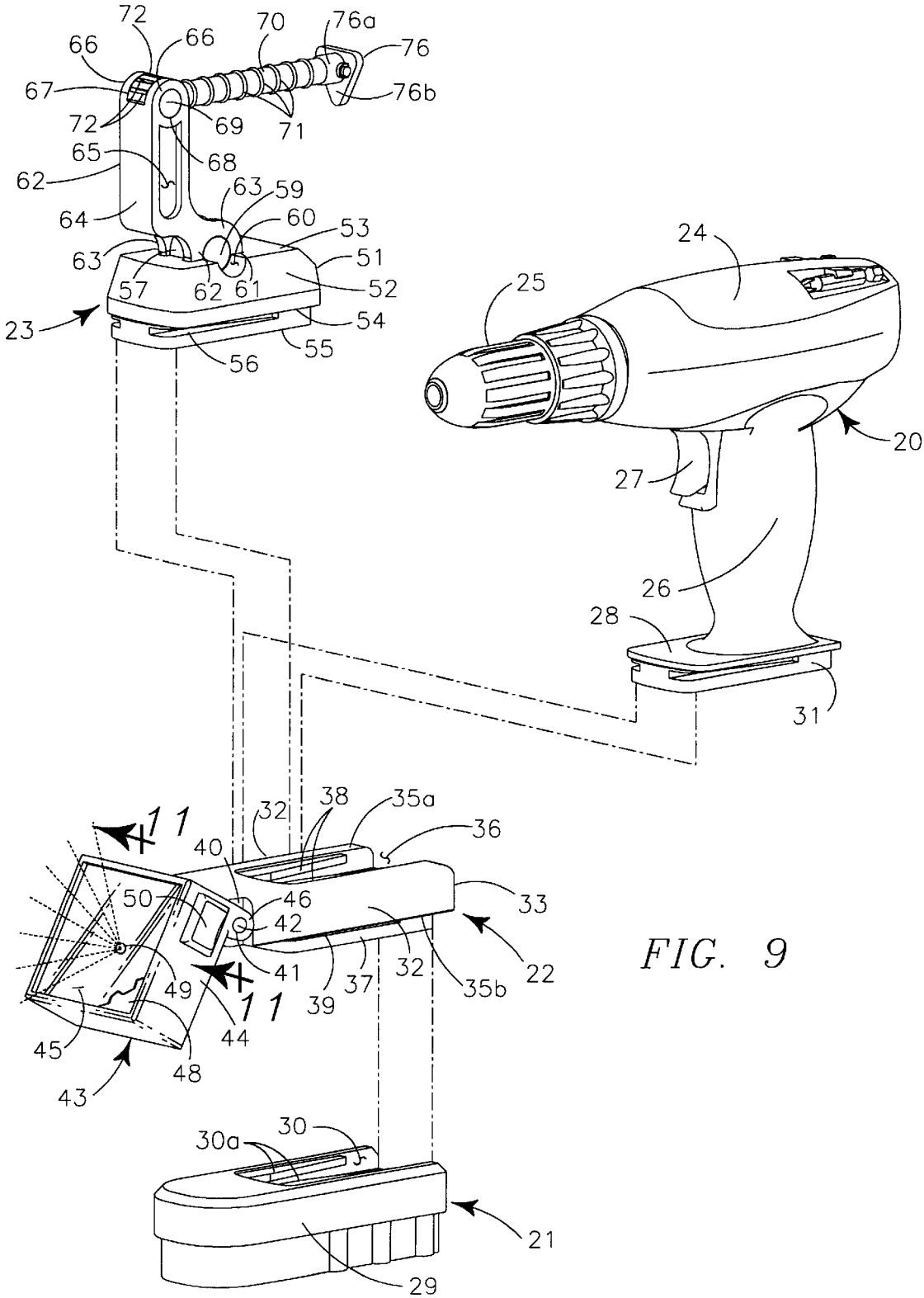
FIG. 9 is an expanded isometric view of the members of my drill light system showing the method of their assemblage.

As seen in the expanded view of FIG. 9, battery connecting structure 28 of the drill 20 and battery casement 29 each define cooperating connecting structures that interfit to releasably interconnect the two members.

Commonly the battery casement 29 will provide a female connecting element 30 and the battery connecting structure 28 will provide a male connector element 31, usually of the tongue and groove type illustrated, to provide both structural and electrical interconnection between the elements. The particular nature, configuration and details of connecting elements 30 and 31 are of a proprietary nature and may vary somewhat with different manufactures. In general, no common single configurational standard has been developed by manufacturers for these connecting elements and my light system therefore generally must be individually configured for use with particular drill and battery connecting structures. These connecting structures are becoming more standardized in the present day, though the appropriate configuration for any particular drill and battery connecting structure is relatively simple to create and well within the skill of any routiner in the present day battery powered drill art.

It is with this type of generically described cordless battery powered drill that my light system is operative.

The light system provides light structure 22 that interfits between battery 21 and drill 20 to provide a releasably integrated drill light. The drill 20 may be removed from the light structure 22 and replaced with associated handle structure 23 to provide a free standing adjustably positionable light powered by the drill battery 21, but totally separate and independent from the drill 20.

The light structure shown in FIGS. 1–7 provides a peripherally defined casement formed by similar opposed sides 32, rearward end 33, forward end 34, top 35*a* and bottom 35*b*, all structurally interconnected in their joining portions, to define upper rearward connecting chamber 36 and lower depending connecting protuberance 37.

The connecting chamber 36 is sized and configured with laterally opposed, inwardly extending tenons 38 to slidably receive and positionally maintain the male connecting element 31 of drill 20 in both structural and electrical interconnection. This interconnection may be positionally maintained by friction between the connected elements, or more appropriately by use of catches or latches (not shown) as commonly used in known battery powered electric drills 20 to positionally maintain battery 21 on the associated drill. The lower depending connecting protuberance 37 is sized and configured with similar laterally opposed, inwardly extending slots 39 similarly to male connecting element 31 of drill 20 so that the lower portion of the light structure may releasably fit and be positionally maintained within female connecting element 30 of associated battery 21.

The forward portions of each side 32 of light structure 22 define similar ear indentations 40 with axle 42 extending therebetween and therebeyond to pivotally mount light source 43. The light source 43 provides peripherally defined rectilinear casement 44 carrying geometrically similar forward rectilinear lens 45 and defining similar rearwardly extending fastening ears 46. Casement 44 is so sized and configured that at least the proximal surfaces of fastening ears 46 fit for pivotal motion within ear indentations 40 defined in light structure 22. To allow fastening ear motion in a smaller space the rearward surfaces of fastening ears 46 are configured as semi-circles. The medial portion of each fastening ear 46 defines axle hole 47 to receive the end portions of axle 42 for pivotal mounting of the light source 43 on the light structure 22. The rectilinear casement 44 is preferably, but not necessarily, so configured that when the casement is vertically positioned the top of the casement 44 is co-planar with the top of light structure 22 and the bottom of the casement is co-planar with the bottom of battery 21, with both sides of the casement being substantially co-planar with sides 32 of the light structure.

The internal chamber defined by casement 44 and lens 45 carries reflector 48 to reflect light beams from light 49 in a forward direction. The casement 44 carries electrical circuitry seen in FIG. 14 to interconnect light 49 through externally accessible switch 50 with battery 21. This light circuitry is not novel per se and since various existing light structures, in essence if properly configured, fulfill the purposes of my invention the structure is not described in detail as it is within the skill and knowledge of a routiner in the drill light art.

Figure 10:
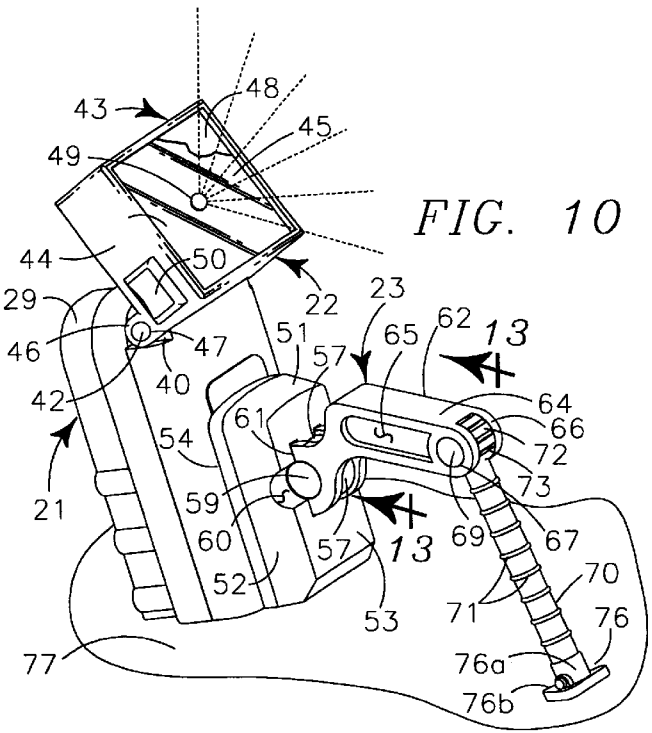
FIG. 10 is isometric view of my light system in its stand alone light mode, supported on an underlying support surface.
Figure 13:
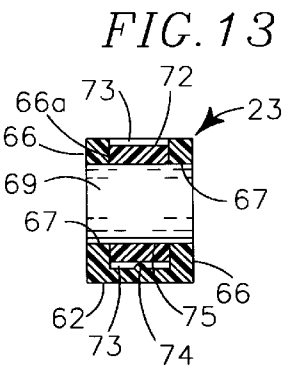
FIG. 13 is a vertical cross-sectional view through the pivotal joint joining the two handle elements, taken on the line 13—13 on FIG. 10 in the direction indicated by the arrows thereon.
Figure 8:
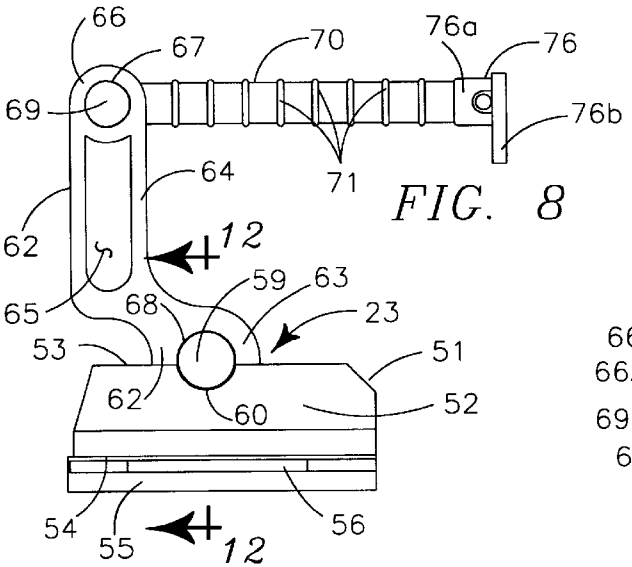
FIG. 8 is an orthographic left side view of handle structure that is selectively carryable by the light structure.
Figure 12:
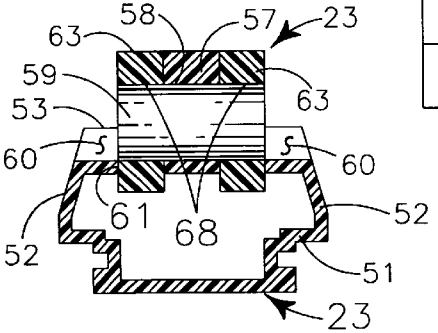
FIG. 12 is an enlarged vertical cross-sectional view through the pivotal joining structure interconnecting the handle to the handle structure, taken on the line 12—12 on FIG. 8 in the direction indicated by the arrows thereon.

Handle structure 23, as seen particularly in FIGS. 8–10, provides handle body 51 having similar sides 52, top 53 and bottom 54. Bottom 54 carries depending fastening structure 55 which is configured similarly to male connecting element 31 of drill 20 to releasably fit within either connecting chamber 36 of light structure 22 or connecting structure 30 of battery 21. The sides of fastening structure 55 define similar opposed side slots 56 to receive connecting protuberances 38 of light structure 22 or similar protuberances 30*a* of connecting chamber 30 of battery 20. The connecting structure 55 may be positionally maintained in connecting chamber 36 of the light structure 22 or in connecting chamber 30 of the battery 21 by frictional engagement therein or by means of known releasable fasteners that cooperate with known fastening devices in structures in which the connecting structure is carried.

Top 53 of the handle body 51 defines medial upstanding handle fastening ear 57 which defines medial hole 58 to pivotably receive handle fastening pin 59. In the instance illustrated the lower portion of handle fastening pin 59 is carried below the top 53 of handle body 51 and to allow placement of the handle fastening pin 59, pin grooves 60 are defined on each side of fastening ear 57 to extend outwardly through both body sides 52. Top 53 defines fastening ear slots 61 laterally outwardly adjacent each side of fastening ear 57 to receive and movably maintain fastening ears of inner handle element 62.

Inner handle element 62 of handle structure 23 is an elongate element defining the similar spaced depending fastening ears 63 in its inner end portion that are interconnected in an offset orientation illustrated. The medial handle portion 64 defines medial elongate hand slot 65 and similar spaced outermost fastening ears 66 defining fastening slot 66*a* therebetween. Fastening ears 63 define medial holes 68 to receive and positionally maintain handle fastening pin 59 and the outer fastening ears 66 define paired opposed holes 67 to receive and positionally maintain outer handle element fastening pin 69.

Outer handle element 70 is an elongate cylindrical element having axially spaced annular protuberances 71 on its external surface to aid griping. The outer handle element 70 carries fastening cylinder 72 at its inner end portion with the axis of the fastening cylinder 72 extending perpendicularly to the axis of the handle element 70. The fastening element 70 defines circumferentially spaced axially parallel grooves 73 about its circumferential surface to cooperate with button-like protuberance 74 carried by the adjacent end portion of inner handle element 62 to aid maintenance of angular positioning of the outer handle element 70 relative to the inner handle element 62, but yet allow selective angular positioning of the element 70 by use of sufficient manual force. The medial portion of fastening element 72 defines axially aligned fastening pin hole 75 to receive and pivotally maintain fastening pin 69 carried by fastening ears 66 of the inner handle element 62. The outer end portion of outer handle element 70 carries cap 76 having medial tubular collar 76*a*, to receive and fastenably interconnect the end portion of outer handle element 70 and structurally interconnected outermost triangular support plate 76*b* to aid support of the outer end portion of the outer handle element 70 on a supporting surface 77 such as in the instance illustrated in FIG. 10.

Having described my light system its use can be understood.

A light system is created according to the foregoing specification for use with a particular drill 20 and compatible removable powering battery 21. The particular drill and battery structure illustrated in the disclosed specific embodiment are of a common, somewhat generically illustrated type available in the present day marketplace but are not intended to be limiting. A light system for a particular drill and battery combination will be configured so that the light structure has an upper connecting chamber 36 that is compatible to interfit with connecting element 31 of the particular drill and a lower depending connecting structure 37 that is compatible to interfit with the connecting structure 30 of the powering battery 21. The configuration of the light structure connecting elements, if different from that illustrated in the specific embodiment, is within the knowledge and skill of an ordinary routiner in the battery powered drill art of the present day. As that art has progressed the configuration of connecting structures of drills and batteries have become somewhat more standardized to allow a single light system of particular configuration to be used on some drills and batteries of different present day manufacturers.

Figure 14:
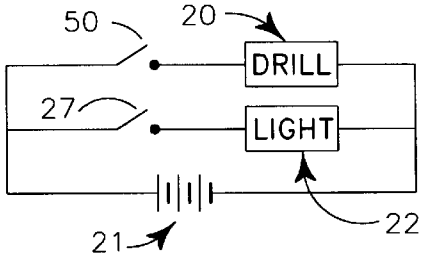
FIG. 14 is an electrical diagram in normal symbology showing the electrical interconnections of the members of my light system.

To use my light system drill 20 is disconnected from its powering battery 21 and the male connecting element 31 of the drill is manually placed for releasable interconnection in connecting chamber 36 of the light structure 22. The battery 21 then is manually manipulated to interconnect its female connecting element 30 with the male connecting element 37 of the light structure. Light structure 22 then is in operative mode as an ordinary drill light interposed between the drill and its powering battery. The light source 43 may be pivotably moved to light the area on a workpiece whereat a bit carried by drill 20 is to operate or it may be moved to illuminate forward portions of the drill or other areas of the workpiece if so desired. The electrical circuitry of the light structure as illustrated in normal symbology in FIG. 14 is such as to place the drill 20 and light structure 22 in electrical interconnection parallel with each other while interconnected to the battery 21 so that the light source 43 may be turned on or off by switch 50 while interconnected between the drill and battery without affecting the operation of the drill as controlled by drill switch 27.

If it be desired to use the drill light system as a stand alone light, battery 21 is interconnected with light structure 22 in the same fashion as for use with the drill 20. Handle structure 23 then is manipulated to move its depending connecting structure 55 into operative mechanical and electrical connection with upper connecting chamber 36 of light structure 22 as shown in FIG. 9. The assembled light structure then may be used as a stand alone light as shown in FIG. 10. The light and battery structures may be directly manually supported for use or may be supported in many varying modes on some underlying supportative surface. The light is particularly useful in a mode similar to that illustrated in FIG. 10 to provide a light beam directed angularly upwardly to light the undersurface of a motor vehicle or other structure supported spacedly thereover.

The foregoing description of my light system is necessarily of a detailed nature so that a specific embodiment of it might be set forth as required, but this is not intended to be limiting and it is to be understood that various modifications of detail, rearrangement and multiplication of parts might be resorted to without departing from its spirit, essence or scope except as limited in the claims.

Having thusly described my invention, what I desire to protect by Letters Patent, and

What I claim is:

1. A light system for a battery powered drill having a depending handle with a lower end portion carrying a battery connecting structure and a battery having an upper portion with drill connecting structure to releasably interconnect the battery connecting structure of the drill, comprising in combination:

a light structure having first means for releasably interconnecting with the battery connecting structure of the drill and second means for releasably interconnecting with the drill connecting structure of the battery, and a handle structure having third means for releasably interconnecting with the first means of the light structure for releasably interconnecting with the battery connecting structure of the drill to form a light independent of the drill.

2. The light system of claim 1 wherein the handle structure comprises:

a handle body having a lower portion defining the third means for releasably interconnecting the light structure and an upper portion carrying a compound handle for pivotal motion in a vertical plane, said compound handle formed by at least two pivotably interconnected handle elements.

3. The light system of claim 1 wherein the light structure has a forward portion and includes:

a light source pivotally mounted forward portion of the light structure for adjustable motion in a vertical plane.

4. A light system for a battery powered drill having an elongate body with a rotatable drill chuck at a forward end and a medial depending handle with battery connecting structure at the lower end portion and a battery with drill connecting structure in an upper portion to releasably interconnect structurally and electrically with the battery connecting structure of the handle, comprising in combination:

light structure having a peripherally defined body with upper, forward and rearward parts, the upper part defining a connecting chamber to releasably interconnect the battery connecting structure of the drill, the lower part defining a depending connecting protuberance to releasably interconnect the drill connecting structure of the battery, and the forward part movably carrying a light source for pivotal motion in a vertical plane, said light source having electric circuitry to interconnect the light source in parallel with the battery connecting structure, and handle structure having a handle body with upper and lower portions, the upper portion movably carrying a compound handle for pivotal motion in a vertical plane, and the lower part carrying connecting structure to releasably interconnect with the connecting chamber in the upper part of the light structure when the light structure is not interconnected to the drill.

5. The light system of claim 4 wherein the compound handle of the handle structure comprises:

a first inner handle element having first means for pivotally fastening to the handle body and extending a spaced distance therefrom to pivotally carry a second outer handle element having second means for pivotally interconnect with the inner handle element and carrying a cap in its end portion distal from the inner handle element to aid support on an underlying supporting surface.

6. The handle structure of claim 5 wherein the fastening means between inner handle element and handle body and between the outer handle element and inner handle element each have means to positionally maintain the angular relationship of the joined elements but allow change of that angular relationship by manual manipulation.

* * * * *